US007693432B2

(12) United States Patent
Belinkov et al.

(10) Patent No.: US 7,693,432 B2
(45) Date of Patent: Apr. 6, 2010

(54) DEVICE THAT ENABLES BLANKET DIAGNOSTICS AND PROOF FOR WEB PRESSES

(75) Inventors: Haim Belinkov, Reshon le zion (IL); Shamai Opfer, Mazkeret Batya (IL); Eyal Peleg, Zoran (IL); Yoav Lengel, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 289 days.

(21) Appl. No.: 11/829,776

(22) Filed: Jul. 27, 2007

(65) Prior Publication Data

US 2009/0028584 A1 Jan. 29, 2009

(51) Int. Cl.
*G03G 15/00* (2006.01)

(52) U.S. Cl. ..... 399/15

(58) Field of Classification Search ..... 399/15, 399/9, 8

See application file for complete search history.

(56) References Cited

U.S. PATENT DOCUMENTS 4,714,340 A * 12/1987 Stillwagon ..... 356/23
5,305,392 A * 4/1994 Longest et al. ..... 382/112
6,112,658 A * 9/2000 Gunther et al. ..... 101/171
6,324,353 B1 * 11/2001 Laussermair et al. ..... 399/16

FOREIGN PATENT DOCUMENTS

DE 3700456 A1 * 7/1987
JP 2006130795 A * 5/2006

OTHER PUBLICATIONS

Computer Translation of JP2006-130795A to Kawakubo.*

* cited by examiner

*Primary Examiner*—Quana M Grainger

(57) ABSTRACT

Example embodiments of systems and methods for performing blanket diagnostics and proofing are disclosed.

30 Claims, 3 Drawing Sheets

DEVICE THAT ENABLES BLANKET DIAGNOSTICS AND PROOF FOR WEB PRESSES

FIELD OF THE INVENTION

The present invention relates to diagnostics and proof of web presses.

BACKGROUND OF THE INVENTION

Interrupts in printing with digital presses are undesired as they reduce productivity and print quality consistency. Interruptions are caused, inter alia, due to the need to check print samples of new printing jobs and/or inspections of the printing blanket or other internal sub systems. This generally requires printing a special job, such as a cleaner page or a test page and inspecting that page. It may also be necessary to print exemplars of a later print job, for inspection before starting that print job. To improve work flow it may be convenient to print such proofs during a previous print job.

In sheet fed printers the printing of a special job interleaved with the output of a long print job is not problematic, since digital presses are capable of fast switching of print content and since a sheet produced by the special job is easily removed from the output or just directed to a bypass tray. However, when the print medium is a web, then the special job must be removed from the web and the web spliced if it is desired to view the sheet out side of the press, or for keeping the output web with current job only without interruptions of special jobs. This reduces the throughput of the printer.

H-P Indigo presses generally comprise a photoreceptor sheet attached to a drum (PIP) on which an image is formed and an intermediate; transfer member (ITM) via which the image is transferred to a final substrate. Occasional cleaning of the ITM is necessary. The devices clean the ITM using a roll of plastic to which a cleaning pattern or a full coverage of the ITM is transferred to remove any particles that may have been accumulated on the ITM. Generally, for safety reasons, the printer is stopped before removing this roll of plastic from the print structure.

SUMMARY OF THE INVENTION

An aspect of come embodiments of the invention relates to performing proofs and diagnostics in parallel to press production. In an exemplary embodiment of the invention a Blanket Cleaning Station (BCS) provided to enable cleaning of the ITM (as described in the Background), is adapted to enable the printing of proof jobs. Alternatively and/or additionally the BCS is also adapted to allow for inspection of the cleaning or test page or the proof page.

Generally, the BCS unit comprises a web, on a roller, which web can be controllably engaged to the ITM to remove images or other toner coverages therefrom. The unit is optionally engaged to the ITM drum by means of pneumatic pistons to clean the ITM.

In an embodiment of the invention, the BCS is constructed such that the web can be viewed after the printing or cleaning cycle. Preferably, this viewing can be performed without stopping the printing of the continuous main job on the main printing station. Furthermore, since the printed special job is generally not printed onto the web of final substrate, there is no break in the printing of images on the web and no need to splice the web or to account for an extra sheet before finishing (e.g., cutting and collating the printed job).

In an exemplary embodiment of the invention, the BCS unit is constructed so that it, or at least a part of it, can be extracted from the printer or rotated to allow viewing of the BCS web after printing of a cleaning cycle or a proof job. As referred herein, the term "remove" refers to extraction or withdrawal of a unit from the press structure, optionally, extracted without being detached from the press structure. As referred herein, the term "printing station" means an area of the printing structure where the image is transferred to a substrate. As referred herein, the term "removable unit" or "removable printing station" means a unit including a substrate. In an exemplary embodiment, the removable printing station does not include an ITM.

Optionally, the BCS is anchored to an inspection position, and the BCS web is optionally slowly inched forward to enable inspection thereof. Optionally, the movement back and forth of the web may be controlled by the inspector, such that the web is inspected during movement. In at exemplary embodiment, the control of the movement back and forth is performed may two motors that enable the movement and apply tension to the web.

In some embodiments of the invention, the web is in the form of a plastic foil. When the foil is transparent or translucent, a white background is optionally provided to enhance viewing and analyzing of the web. Optionally, the white background enables analyzing of registration, resolution and/or color quality of the print.

In an exemplary embodiment there is further provided a safety switch for stopping the movement inside the BCS unit before extraction.

In an exemplary embodiment of the invention, the BCS web is analyzed for flaws on a full print. Flaws on a full print indicate problems either with the transfer blanket or the photoreceptor. Optionally, the BCS web constitutes a proof job for inspection.

BRIEF DESCRIPTION OF THE DRAWINGS

Non-limiting examples of embodiments of the present invention are described below with reference to figures attached hereto, which are listed following this paragraph. In the figures, identical structures, elements or parts that appear in more than one figure are generally labeled with a same symbol in all the figures in which they appear. Dimensions of components and features shown in the figures are chosen for convenience and clarity of presentation and are not necessarily shown to scale.

DETAILED DESCRIPTION OF EMBODIMENTS OF THE INVENTION

Figure 1:
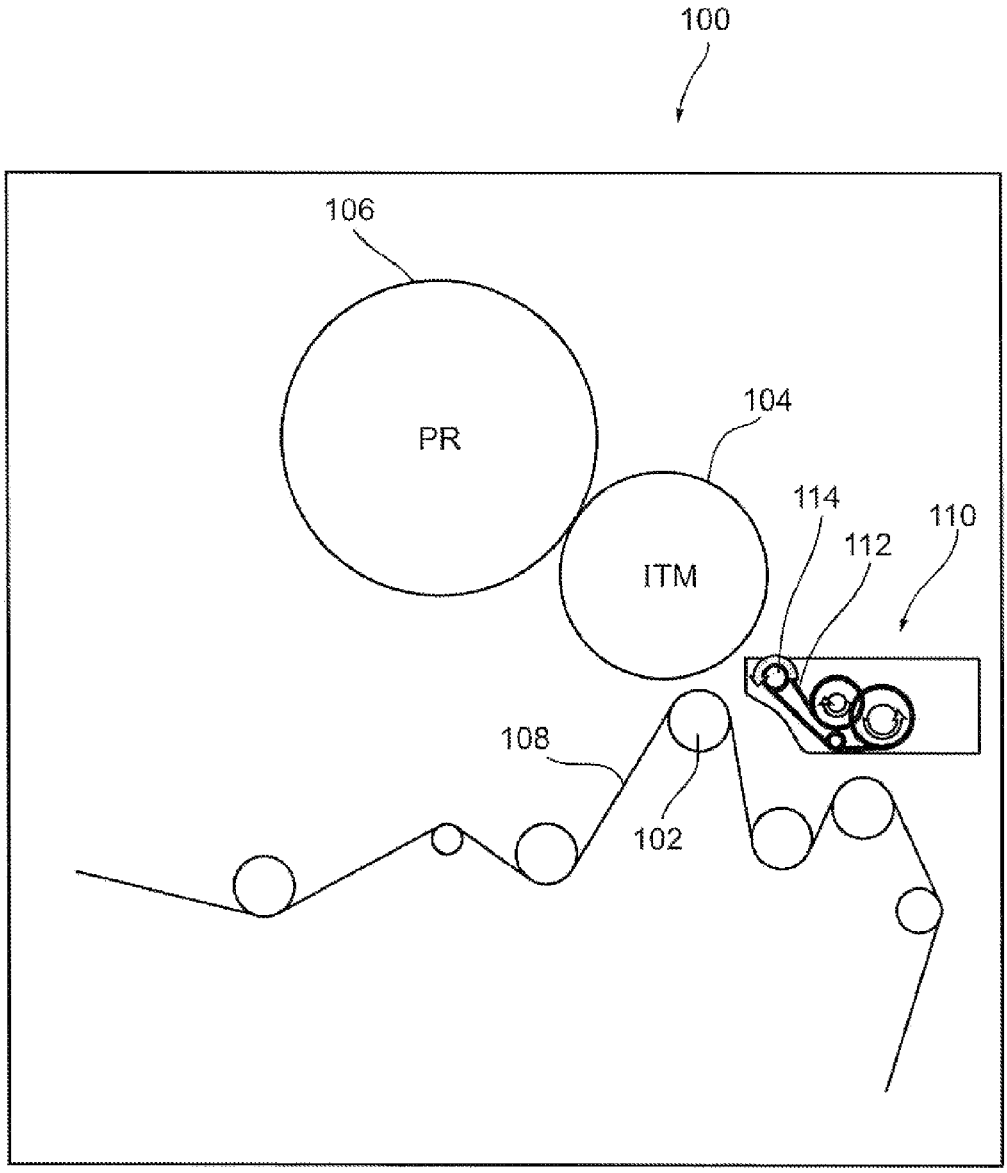
FIG. 1 is a schematic presentation of a press structure including a BCS unit in accordance with an exemplary embodiment of the invention.

FIG. 1 is a schematic presentation of a portion of a press structure 100 in accordance with an exemplary embodiment of the invention.

Press structure 100 includes, in accordance with an exemplary embodiment of the invention, a photoreceptor 106 on which an image is formed, an ITM 104 which receives a toner image formed on photoreceptor 106 and transfers it to a final substrate 108, shown here in the form of a web, and a BCS 110. The image can be formed on the photoreceptor in any known manner and the method of forming the image does not constitute a part of the invention per se. The structure need for forming the image is therefore not shown in FIG. 1. In an exemplary embodiment of the invention, the image on the photoreceptor is a liquid toner image.

BSC 110 includes a web 112. Both final substrate 108 and web 112 are shown as being disengaged from the ITM. However, the printer is provided with mechanisms, as known in the art, for bringing one or the other of substrate 108 or web 112 into engagement with the ITM, usually under control of a computer or other controller (not shown) such as is customarily used for controlling the operation of digital printers. Thus, an image or other toner coverage formed on photoreceptor 106 and transferred to ITM 104 can be transferred to or printed either on substrate 108 by engaging an impression roller 102 toward ITM 104, or on BCS web 112, by urging a backing roller 114 toward ITM 104.

Final substrate 108 can be any material customarily utilized for this purpose that is suitable for the printing process being used and web 112 is similarly any material that will take up any toner on the intermediate transfer member. For use with HP-Indigo inks as used in HP-Indigo digital presses, it has been found suitable to utilize a PET foil, optionally coated with a coating that enhances transfer to the foil. Such coatings are widely reported in the art. It should be noted that while substrate 112 is referred herein as a web, other printing substrates, such as sheets (e.g., of paper) may be used in accordance with exemplary embodiments of the invention.

During a print job, it is sometimes desired to perform print jobs which are unrelated to the printing job which is presently printed. Such unrelated prints, referred herein as single print cycles or single images, may be proof jobs to allow for alignment or control of future print jobs or cleaning cycles to remove various contaminations, such as ink residues and residues from substrates from the ITM. Single-color, multi-color, multi-layer images made up of a plurality of color separations are also included in the definition of an image. Final substrate 108 is usually a more expensive substrate than BCS web 112.

It is to be understood that in the prior art usage of BCS 110 (as a cleaning mechanism) there was no need to view web 112. However, the present inventors have realized that the transferred portion of the cleaning pattern or full coating (sky shot) of ITM 104 can be used to determine if the image formation on the photoreceptor and the transfer to the ITM is operating properly and to identify flaws on the ITM or photoreceptor that indicate a need to replace one or both of them. They have also discovered that when a proof or test print is transferred to web 112, this can be used to adjust the printer and/or the alignment between colors in a job or the color characteristics so that a next job can be initiated more quickly.

In the past, these processes were carried out by printing on the final substrate and viewing that substrate. However, this requires stopping the printer to either remove the printed area for inspection and preferably cutting out a length of the web of final substrate 108 for closer inspection and splicing the cut web in order to continue the regular print job. This takes substantial time and can significantly reduce the throughput of the printer.

The present inventors have discovered that when the special print job is printed on BCS web 112, the analysis and control processes that can be carried out on this print is generally enough and printing test or proof jobs on the final substrate during a print run is not necessary, or needed to much less extent, according to the job and application.

In an embodiment of the invention, special print jobs printed on BCS web 112 are analyzed and inspected for flaws in the print. The analyzed flaws may indicate problems with the transfer blanket or the photoreceptor, such as flaws or other defects. In an exemplary embodiment, web 112 may be pulled out of structure 100 for inspection.

Additionally or alternatively, for inspection of proof jobs, a print of the proof image is transferred to ITM 104 and transferred from the ITM to BCS web 112. BCS unit 110 is then pulled out of structure 100 and web 112 is inspected.

Optionally, web 112 (which is preferably a transparent foil of PET) is placed against a white background for ease of inspection. Optionally, the web is analyzed to inspect the resolution of the print. Alternatively or additionally, the web is analyzed to inspect the color quality of the print.

In an exemplary embodiment of the invention, BCS web 112 may be inspected without stopping the printing cycle. BCS unit 110 may be pulled out and the web inspected while printing of the main printing job on final substrate 108 continues without stopping the press. The only loss of productivity is one printing cycle needed to print the special job onto web 112.

There are several advantages for not stopping the printing cycle. The press is a production tool, and stopping the printer results in reduction of revenues to the press owner. Also, print quality and consistency are best kept when the printing is continuous and reliability of the printer is improved when the printer works without interruptions. Moreover, the pharmaceutical market prohibits splices on the printed substrates, as part of an effort to reduce drugs counterfeits.

Figure 3:
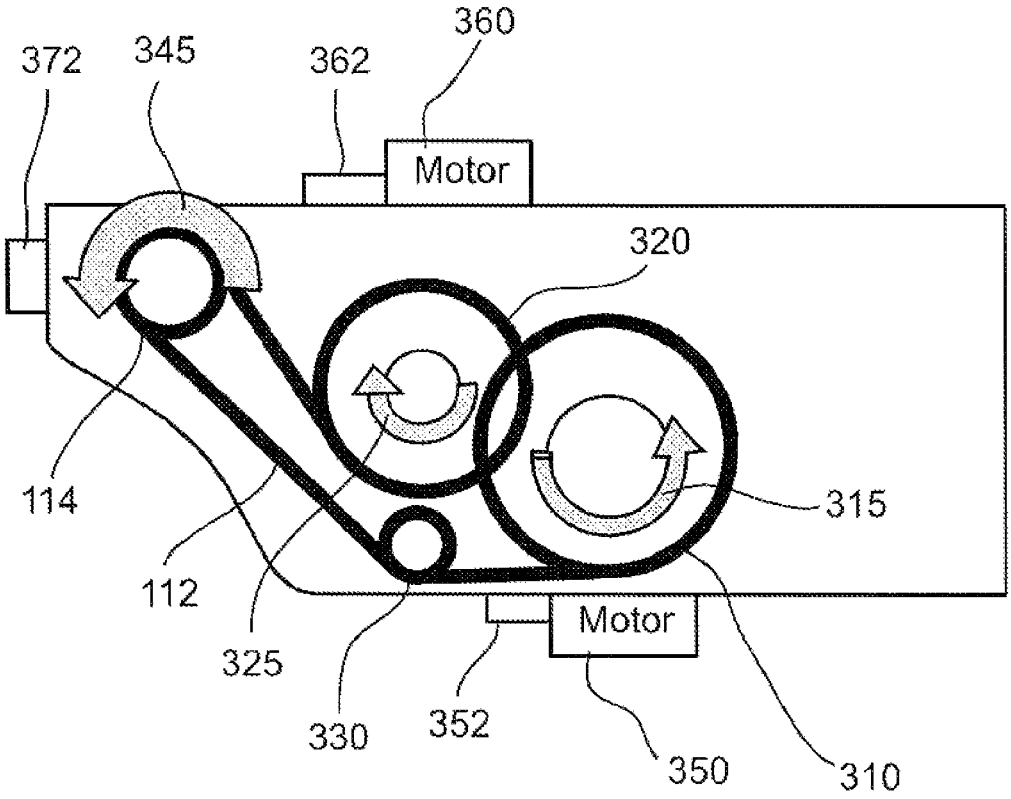
FIG. 3 is a closer view of the BCS web depicted in FIG. 1 in accordance with an exemplary embodiment of the invention.

A closer view of BCS unit 110, in accordance with an exemplary embodiment of the invention, is shown in FIG. 3. Unit 110 includes a web 112 and four rollers, 310, 320, 114 and 330. Web 112 is collected on unwind roller 320 from which it continues to backing roller 114, which is controllably engaged to ITM 104 for printing, optionally by means of pneumatic piston pairs. After printing the web returns through idler 330 to rewind roller 310.

Unit 110 optionally comprises several motors for controlling and powering the speed of its rollers and encoders for measuring the angular velocity of the rollers. Unwinder 320 is optionally powered by a DC motor 350 and its speed is measured by an encoder 352. Rewinder 310 is optionally powered by a servo motor 360 and an encoder 362 and backing roller 114 is connected to an encoder 372. It should be noted that the encoders may be replaced by any other angular velocity measurer known in the art and other types of motors may be used. It should be clearly understood that the structure shown are exemplary and that other structures for performing the same functions can be used. Arrows 315, 325 and 345 indicate the rotating direction of rewinder 310, unwinder 320 and roller 114 respectively.

Following is a description of the operation of BCS unit 110. A printing cycle on file BCS unit is initiated by a controller (not shown) in press structure 100. Optionally, the print of a proof job or cleaning cycle is manually initiated by a person managing the printer. Alternatively or additionally, a cleaning cycle on BCS unit is automatically initiated periodically after a predetermined operation time or number of print cycles.

In an exemplary embodiment, before engaging web 112 to ITM 104 for printing thereon, BCS unit 110 accelerates web 112 to the speed of ITM 104 in order to prevent slip when engaged. Thus, the relative speed between backing roller 114 (and web 112) and ITM 104 should be zero. First DC motor 350 accelerates unwinder 320 to speed up. At the same time, servo motor 360 accelerates rewinder 310 to reach the same speed. During rotation, due to the movement of web 112, the diameter of unwinder 320 grows smaller and the diameter of rewinder 310 increases in size. Encoders 352 and 362 assist in measuring the velocity of the web to control the rotation of the unwinder and rewinder rollers such that the web speed is the same as the surface speed of ITM 104, during change in size of their diameters.

When web 112 reaches the speed of ITM 104, backing roller 114 engages the ITM, and the print is transferred to web 112. Optionally, motor 350 is programmed to a slightly higher speed than the ITM's speed, so that tension is maintained against the blanket. Upon completion of the print job on web 112, backing roller 114 disengages from ITM 104. In an exemplary embodiment of the invention, DC motor 350 reduces the speed of unwinder 320 until final stop. Alternatively, the rollers stop rotating only when. BCS unit is pulled out of structure 100 for inspection. However, continuous motion of web 112 inside BCS unit 110 without printing thereon causes unnecessary waste of web 112 and requires rewind of the web when viewing is desired.

Figure 2A:
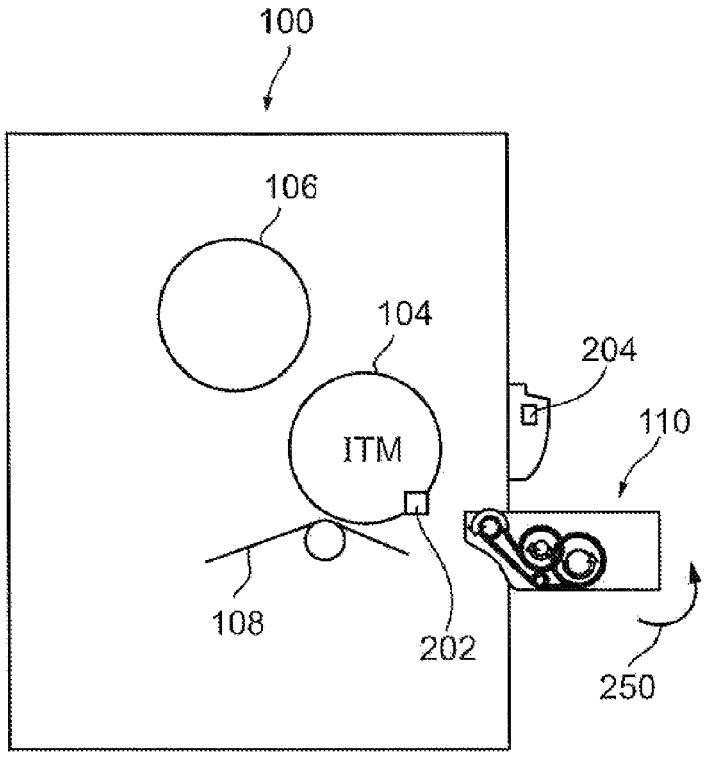
FIGS. 2A and 2B are schematic presentations of BCS unit of FIG. 1 that is being removed for inspection in accordance with an exemplary embodiment of the invention.

FIG. 1 shows BCS unit 110 in place (but disengaged) during the printing process. Removal of BCS unit 110 for inspection, according to an exemplary embodiment of the invention, is depicted in FIGS. 2A and 2B.

In order to inspect web 112, according to an exemplary embodiment of the invention, unit 110 is pulled out of printing structure 100 and is then anchored in suitable reviewing position. FIG. 2A depicts BCS unit 110 pulled out of structure 100 and FIG. 2B depicts BCS unit 110 anchored in an inspection position for analyzing the print on web 112. Unit 110 rewinds the web in the direction indicated by arrow 250 to a suitable reviewing angle for inspection. Optionally, unit 110 may be manually rotated by an inspector. Optionally, BCS unit 110 is automatically anchored to a predefined inspection position, when not in operation.

Figure 2B:
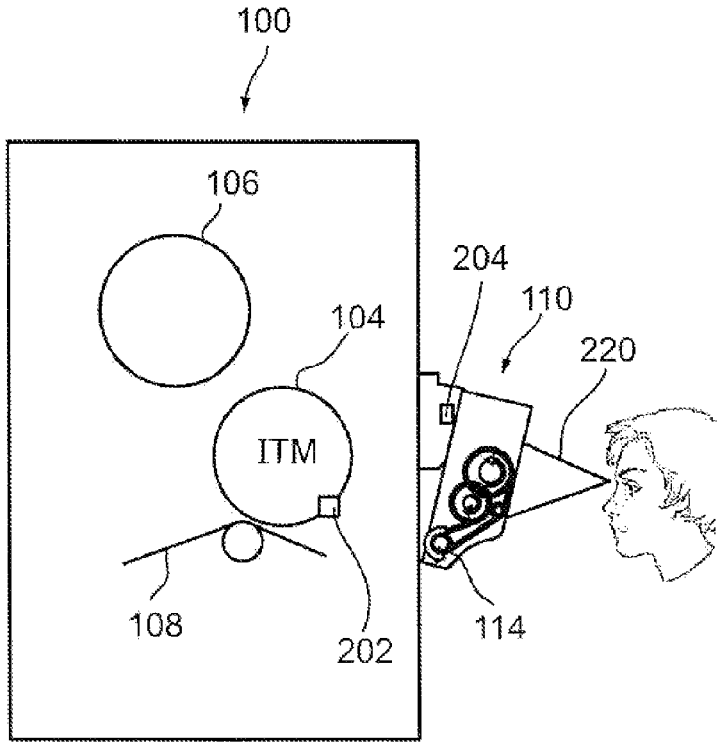

FIG. 2B depicts an inspection position at which web 112 may be reviewed at an inspection angle 220. Web 112 is preferably inspected in the portion between idler 330 and rewinder 310. It may be necessary to inspect the web in sections, especially if the printed length is longer than the distance between rollers 310 and 330.

The velocity during printing process is generally high, which may be dangerous if operation is allowed when the BCS unit is extracted. Therefore, in accordance with an exemplary embodiment of the invention, a safety switch 202 is provided to signal if the BCS unit is in place or pulled out, in order to ensure that unit 110 is stopped when unit 110 is pulled out, except for the slow speeds utilized during inspection.

Safety switch 202 is optionally positioned near ITM 104 and is turned on when unit 110 is in place, as shown in FIG. 1. When unit 110 is pulled out, the unit releases switch 202 and switch 202 is turned off, stopping normal operation of the BCS. If the rollers in unit 110 are rotating when unit 110 is pulled out, switch 202 activates DC motor 350 to reduce the rotation of unwinder 320 until a complete stop. When switch 202 is turned back on, DC motor 350 optionally re-accelerates the rotation of unwinder 320. However, it should be noted that normally, the BCS moves web 112 only when (and just before) the web engages the ITM. Thus, the switches do not normally control the speed of the web, but act as a safety, so that the printer does not inadvertently turn on the motors in the BCS.

A further switch 204 is optionally provided for indication that the BCS is anchored in an inspection position, as shown in FIG. 2B. Switch 204 is turned off when unit 110 is not in the inspection position.

Optionally, when switch 204 is turned on, the BCS web is slowly inched forwards and/or backwards by motors 350 and 360 to allow inspection of web 140, either automatically or under control of the inspector. Alternatively, when switch 204 is turned on, manually inching of web 140 is allowed. Manually inching of the web may include both backwards and forwards inching. In an exemplary embodiment of the invention, the tension of the web is maintained DC motor 350 and servo motor 360.

In an exemplary embodiment of the invention, there is further provided a white background (not shown) to provide a clearer view of the printed web. This background may be placed behind the web by the inspector.

When the two switches 202 and 204 are turned off no movement inside unit 110 is allowed.

It should be noted that the present invention may be earned out on a printing structure having multiple printing engines, each including a main printing station and a BCS.

While the invention has been described with respect to a printer using an ITM, it is understood that the invention can also be practices when direct transfer from the photoreceptor to the final substrate takes place. In this embodiment the BCS controllably engages the photoreceptor. Optionally, in this embodiment, backing roller 114 is comprised from a material to suit the hardness of the photoreceptor.

In addition, while the invention has been described with respect to a liquid toner printer, the invention can be practiced with a powder tone printer, with or without an ITM.

Finally white the invention has been described with respect to a printer in which the image is formed on a photoreceptor, the invention can be utilized in any system which produces an image on a surface, for transfer to a final substrate.

It is noted that some of the above described embodiments may describe a best mode contemplated by the inventors and therefore may include structure, acts or details of structures and acts that may not be essential to the invention and which are described as examples. Structure and acts described herein are replaceable by equivalents which perform the same function, even if the structure or acts are different, as known in the art. Therefore, the scope of the invention is limited only by the elements and limitations as used in the claims. When used in the following claims, the terms "comprise", "include", "have" and their conjugates mean "including but not limited to".

It will be appreciated by persons skilled in the art that the scope of the present invention is not limited by what has been particularly shown and described above. Rather, the scope of the invention is limited solely by the claims, which follow.

The invention claimed is:

1. A method for inspecting a print, comprising:

printing a continuous print job on a main web substrate by transferring marking material in the form of images thereto from an image carrier element;

interrupting printing of the continuous print job to print at least one print cycle on a secondary substrate by transferring marking material in the form of at least one image thereto from said image carrier element, wherein the secondary substrate and the main web are separated from each other; and inspecting said secondary substrate during printing of said continuous print job after said interruption.

2. A method according to claim 1, wherein inspecting comprises removing said secondary substrate from the printer.

3. A method according to claim 2 wherein the secondary substrate is a web of material.

4. A method according to claim 3, wherein the web is mounted on a web carrier and wherein the web is inched forward and/or backward in the carrier for viewing, after removal.

5. A method according to claim 1, wherein the at least one print cycle is a test print cycle.

6. A method according to claim 5, wherein inspecting comprises inspecting the print for indications of problems with the image carrier element or with image formation in the printer.

7. A method according to claim 6, wherein inspecting comprises inspecting for flaws on the at least one image.

8. A method according to claim 6 wherein the at least one print cycle is a cleaning cycle.

9. A method according to claim 1, wherein the at least one print cycle is a proof.

10. A method according to claim 9, wherein the secondary substrate is substantially transparent and wherein inspecting comprises providing a white background to the secondary substrate.

11. A method according to claim 1, wherein the secondary substrate is a plastic foil.

12. A method according to claim 1, wherein the secondary substrate is a paper sheet.

13. A method according to claim 1, wherein interrupting comprises interrupting without stopping the rotation of the image carrier element.

14. A printer, comprising:

an image carrier element;

at least one main printing station adapted for continuously printing on a main web substrate by transferring marking material in the form of images thereto from the image carrier element; and at least one second printing station adapted for printing at least one print cycle on a second substrate by transferring marking material in the form of at least one image from the image carrier element, without stopping the rotation of the image carrier element, wherein the at least one second printing station is adapted to enable inspection of the at least one image for operation of the printer, without interrupting the print on the main web substrate.

15. A printer according to claim 14, wherein the at least one second print station is adapted to be removed from the printer for inspection of the single image.

16. A printer according to claim 14, wherein the second substrate is a web of material.

17. A printer according to claim 16, wherein the at least one second printing station comprises a web carrier adapted to mount the web such that the web may be inched one or both of forward and backward in the carrier, after removal of the at least one second print station.

18. A printer according to claim 14, wherein the at least one second printing station is adapted for printing a cleaning cycle on the second substrate.

19. A printer according to claim 14, wherein the at least one second print station is adapted for printing a proof on the second substrate.

20. A printer according to claim 12, wherein the at least one second printing station is adapted for printing a test print cycle on the second substrate.

21. A printer according to claim 20, wherein the at least one second printing station is adapted to enable inspection of the at least one image for indication of problems with the image carrier element or with image formation in the printer.

22. A printer according to claim 21, wherein the at least one second printing station is adapted to enable inspection of the at least one image for flaws on the at least one image.

23. A printer according to claim 14, wherein the second substrate is a plastic foil.

24. A printer according to claim 14, wherein the second substrate is a paper sheet.

25. A printer according to claim 14, further comprising a white background to the second substrate for inspection of the at least one image.

26. A printer according to claim 14, wherein the at least one image carrier is a photoreceptor.

27. A printer according to claim 14, wherein the image carrier element is an intermediate transfer member to which the marking material in the form of images is transferred.

28. A printer according to claim 14, wherein at least one image comprises three images.

29. A printer, comprising:

an image carrier element;

at least one main printing station adapted for continuously printing on a main web substrate by transferring marking material in the form of images thereto from the image carrier element; and at least one second removable printing station comprising a second substrate, said at least one second station adapted for printing at least one print cycle on the second substrate by transferring marking material in the form of at least one image from the image carrier element, without stopping the rotation of the image carrier element, wherein the at least one second removable printing station is adapted to be removed from the printer, without interrupting the print on said main web substrate.

30. A printer according to claim 29, wherein the printer comprises a safety switch for stopping the movement inside the at least one second removable printing station before removal thereof.

* * * * *